US005617693A

United States Patent [19]

Hefner

[11] Patent Number: 5,617,693

[45] Date of Patent: Apr. 8, 1997

[54] PREFABRICATED WALL TRUSSES FOR SUPER-INSULATED WALLS

[76] Inventor: Richard P. Hefner, 1905 Anhalt Dr., Madison, Wis. 53704

[21] Appl. No.: 589,615

[22] Filed: Jan. 22, 1996

[51] Int. Cl.[6] ..... E04C 3/292; E04C 3/16

[52] U.S. Cl. ..... 52/693; 52/169.11; 52/265; 52/289; 52/293.3; 52/733.2

[58] Field of Search ..... 52/169.5, 169.11, 52/169.14, 236.6, 236.7, 265, 268, 269, 283, 289, 293.1, 293.3, 299, 407.3, 690, 693, 694, 695, 733.2

[56] References Cited

U.S. PATENT DOCUMENTS

| | | | |
|---|---|---|---|
| 1,219,840 | 3/1917 | Monrath | 52/265 |
| 1,868,168 | 7/1932 | Hull . | |
| 2,191,804 | 2/1940 | O'Malley | 52/693 X |
| 3,345,792 | 10/1967 | Chandler | 52/693 X |
| 3,861,109 | 1/1975 | Hunt et al. | 52/693 |
| 4,224,774 | 9/1980 | Petersen | 52/404 |
| 4,435,929 | 3/1984 | Bussell | 52/690 X |
| 4,617,776 | 10/1986 | Bergström | 52/690 |
| 4,619,090 | 10/1986 | McManus | 52/235 |
| 4,677,806 | 7/1987 | Tuomi | 52/656.1 |
| 4,887,406 | 12/1989 | Saia | 52/694 |
| 4,928,468 | 5/1990 | Phillips | 52/574 |
| 5,144,785 | 9/1992 | Berglund | 52/690 X |

FOREIGN PATENT DOCUMENTS

| | | | |
|---|---|---|---|
| 1062870 | 9/1979 | Canada | 52/693 |
| 2052596 | 1/1981 | United Kingdom | 52/690 |

OTHER PUBLICATIONS

"High Efficiency at Low Cost" by Jim Young, *Fine Homebuilding*, Spring, 1994 Edition, pp. 79–81.

1982 Sweet's Catalog.

1995 Sweet's Catalog.

*Primary Examiner*—Carl D. Friedman

*Assistant Examiner*—Kevin D. Wilkens

*Attorney, Agent, or Firm*—Lathrop & Clark

[57] ABSTRACT

A truss which is premanufactured and shipped to a job site for the construction of supper-insulated buildings walls has a two-by-four stud which is joined to a two-by-two stud positioned in spaced parallel relation to the first stud to form a twelve inch wide insulation cavity. The two-by-two stud is spaced from the two-by-four stud by spacers and is rigidly supported by diagonal cross braces. The braces and spacers are joined to the two-by-four stud by truss plates. A foundation, is especially designed to accommodate the wall truss members. The truss has a sill extension 8½ inches wide formed of two-by-twos. The extension extends downwardly from the truss structure to provide an insulation face across the front of a step in the foundation. The wall trusses may be manufactured with the same equipment as utilized in the construction of floor and rafter trusses formed of dimensional two-by-fours. The ability to shop-fabricate the wall trusses using truss plates means that engineered truss members for each job can be supplied which minimize utilized material while, at the same time, saving considerable labor over on-site construction.

9 Claims, 3 Drawing Sheets

FIG. 1
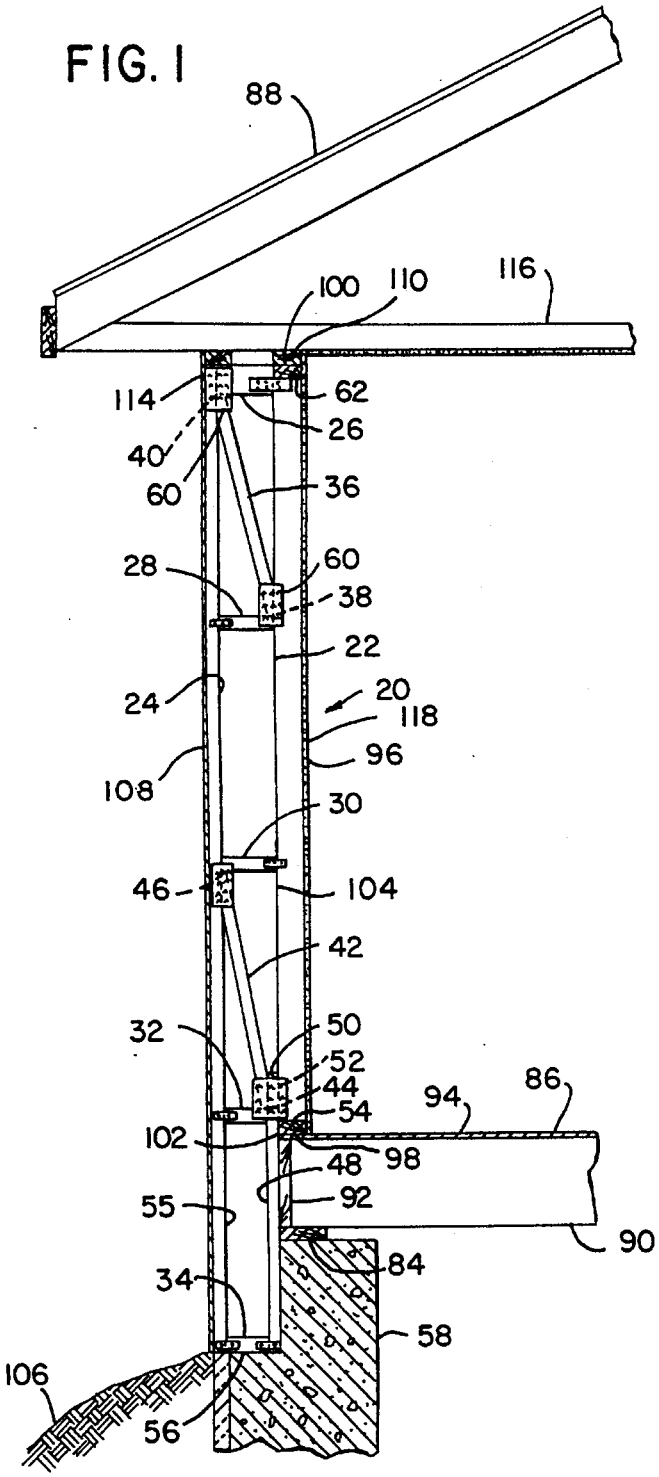
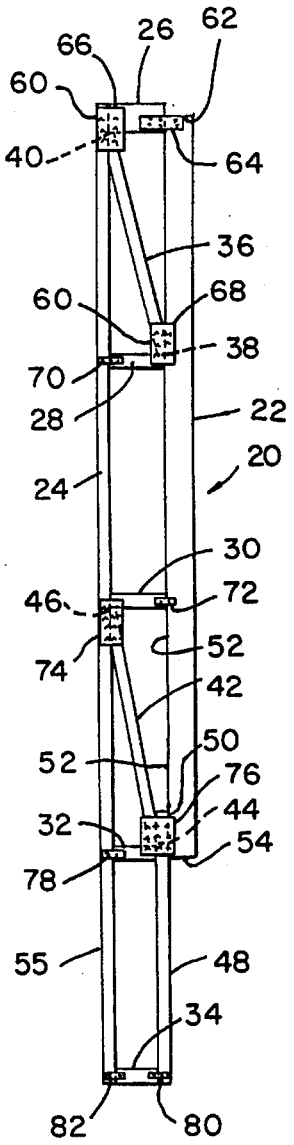
FIG. 2

FIG. 4
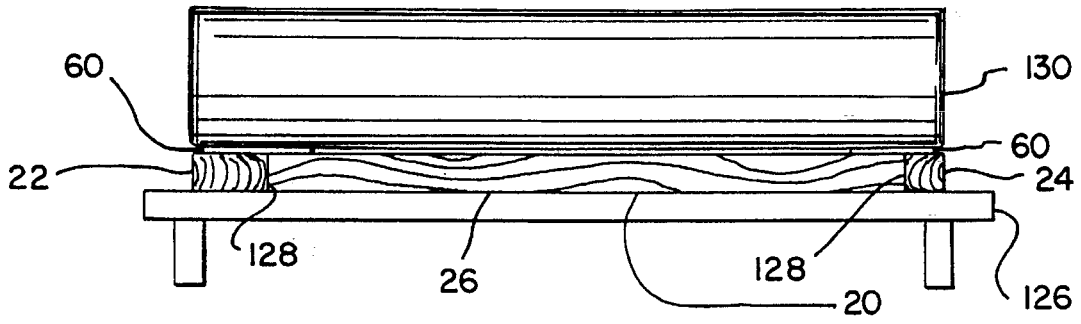
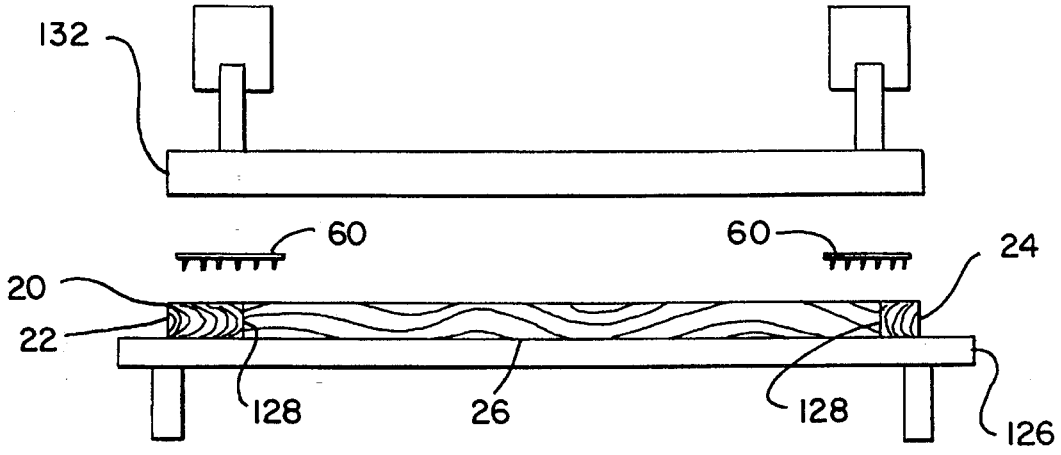
FIG. 5

PREFABRICATED WALL TRUSSES FOR SUPER-INSULATED WALLS

FIELD OF THE INVENTION

The present invention relates to prefabricated wooden trusses in general and trusses for creating super-insulated buildings in particular.

BACKGROUND OF THE INVENTION

One of the results of the energy crisis of the early '70's was a renewed focus on energy efficient designs for homes and buildings. Many of the energy efficient designs developed during the 1970's and 1980's focused on the collection, storage and distribution of heat energy. Such designs often resulted in architecturally unique structures. Often the designs, especially those using solar energy, were dependent on machinery. Even passive designs required massive heat sinks and, sometimes expensive, architectural details.

In recent years a better understanding of how heat migrates out of a house or building through air leaks and underinsulated walls has led to new designs. These designs employ recently developed technology in mechanical ventilation which assures an adequate supply of fresh air to a home or office while recovering a substantial portion of the heat contained in the air vented from the house. Technological improvements in the design of super-insulated windows, in combination with high R-value walls and ceilings, together with tight construction, has resulted in a new type of energy efficient building designs. These designs lose very little heat and thus the building or house can rely on the heat supplied by the building's occupants and the appliances and lighting to supply the majority of the heat required by the building. Supplemental electrical heat or a wood stove is easily sufficient to heat the super-insulated building.

The key to the design of the super-insulated building is the use of walls and roof which allow the installation of as much as a foot or more of insulation which, in turn, produces R-values of 50 or more.

One type of system known as the Larsen truss, was designed by John Larsen, a builder in Alberta, Canada, more than a decade ago. His system, as described in an article in *Fine Home Building,* Spring 1994, by Jim Young at page 79, is produced with two-by-two vertical cords which had been dadoed to accept one foot squares of ¾ inch plywood spaced every two or three feet. These trusses or similar ones such as described in the *Fine Home Building* article, are nailed on to the exterior walls of the house into the headers and rim joists. The trusses are then joined to each other with short lengths of two-by-threes toenailed to each other and into the cords of the trusses. To anchor each truss at the top of the walls of the house the uppermost plywood gusset is extended an inch and ½ and nailed to adjacent roof trusses. The use of Larsen trusses, as described in the *Fine Home Building* article, is quite effective. A house measuring 2,600 square feet had a heating bill of only $225.00 a year and is located in an area that experienced 8000 heating degree days per year.

Larsen trusses, while effective in producing super-insulated buildings, have some drawbacks in regard to cost and limitations imposed in the construction process. In the *Fine Home Building* article, the author, Jim Young, attributes almost half the cost of installing and utilizing the Larsen trusses to the additional labor used on the trusses. This labor amounted to over three times the cost of the materials used in the trusses.

An additional complication of the use of Larsen trusses is that they are in part hung from the roof trusses. Thus, before they can be installed the roof trusses must be installed. Further, the roof trusses then must be designed to support the additional overhang together with the loads imposed by the hanging trusses. In a conventional house or small office building the first floor of the building is constructed on a platform or floor constructed on joists laid on the foundation walls. The first story walls of the house are then erected on the floor. Once the walls are erected the roof trusses are positioned on the upper sill of the walls and the roof and the walls of the building are sheathed and enclosed. The use of external super-insulated trusses results in an additional step in the construction process which can add to overall costs.

Other methods of forming super-insulated walls including building two conventional walls spaced apart or using large dimensional framing timbers such as two-by-twelves requires considerable additional labor and materials.

What is needed is a system for building super-insulated homes and offices where the superinsulation is integral with the construction of the walls.

SUMMARY OF THE INVENTION

The invention is comprised of a truss which is premanufactured and shipped to a job site for the construction of supper-insulated building walls. The trusses have a two-by-four stud which is joined to a two-by-two stud positioned in spaced parallel relation to the first stud to form a twelve inch wide insulation cavity. The two-by-two stud is spaced from the two-by-four stud by spacers and is rigidly supported by diagonal cross braces. The diagonal cross braces and the spacers are joined to the two-by-four stud by grip plates. A foundation has a step which is especially designed to accommodate the wall truss members. Each truss has a sill extension 8½ inch wide formed of two-by-twos which extend downwardly from the truss structure to provide an insulation face across the front of the step in the foundation.

The wall trusses are manufactured with the same equipment as utilized in the construction of floor and rafter trusses formed of dimensional two-by-fours. The ability to shop-fabricate the wall trusses using truss plates means that engineered truss members for each job can be supplied, thereby minimizing material utilized while at the same time saving considerable labor over on-site construction.

It is an object of the present invention to provide a wall truss for the construction of super-insulated walls which can be manufactured by floor truss manufacturing shops.

It is a further object of the present invention to provide wall trusses for a super-insulated wall which reduce material and labor costs.

It is a further object of the present invention to lower the life cycle cost of dwelling and office structures by minimizing energy use over the life of the structure while minimizing up-front costs of installing additional insulation.

It is a further object of the present invention to provide a system for framing the walls of a building employing specially designed trusses which facilitate the construction of super-insulated walls.

Further objects, features and advantages of the invention will be apparent from the following detailed description when taken in conjunction with the accompanying drawings.

BRIEF DESCRIPTION OF THE DRAWINGS

FIG. 1 is a cross-sectional view of a building showing the truss of the invention forming a super-insulated wall.

FIG. 2 is a side view of the truss of FIG. 1

FIG. 4 is a front elevational view of the truss of FIG. 2 being assembled by rolling the truss files into engagement with the wood members of the truss.

FIG. 5 is a front elevational view of the truss of FIG. 4 being assembled by pressing the truss plates into engagement with the wood members of the truss.

DESCRIPTION OF THE PREFERRED EMBODIMENT

Figure 3:
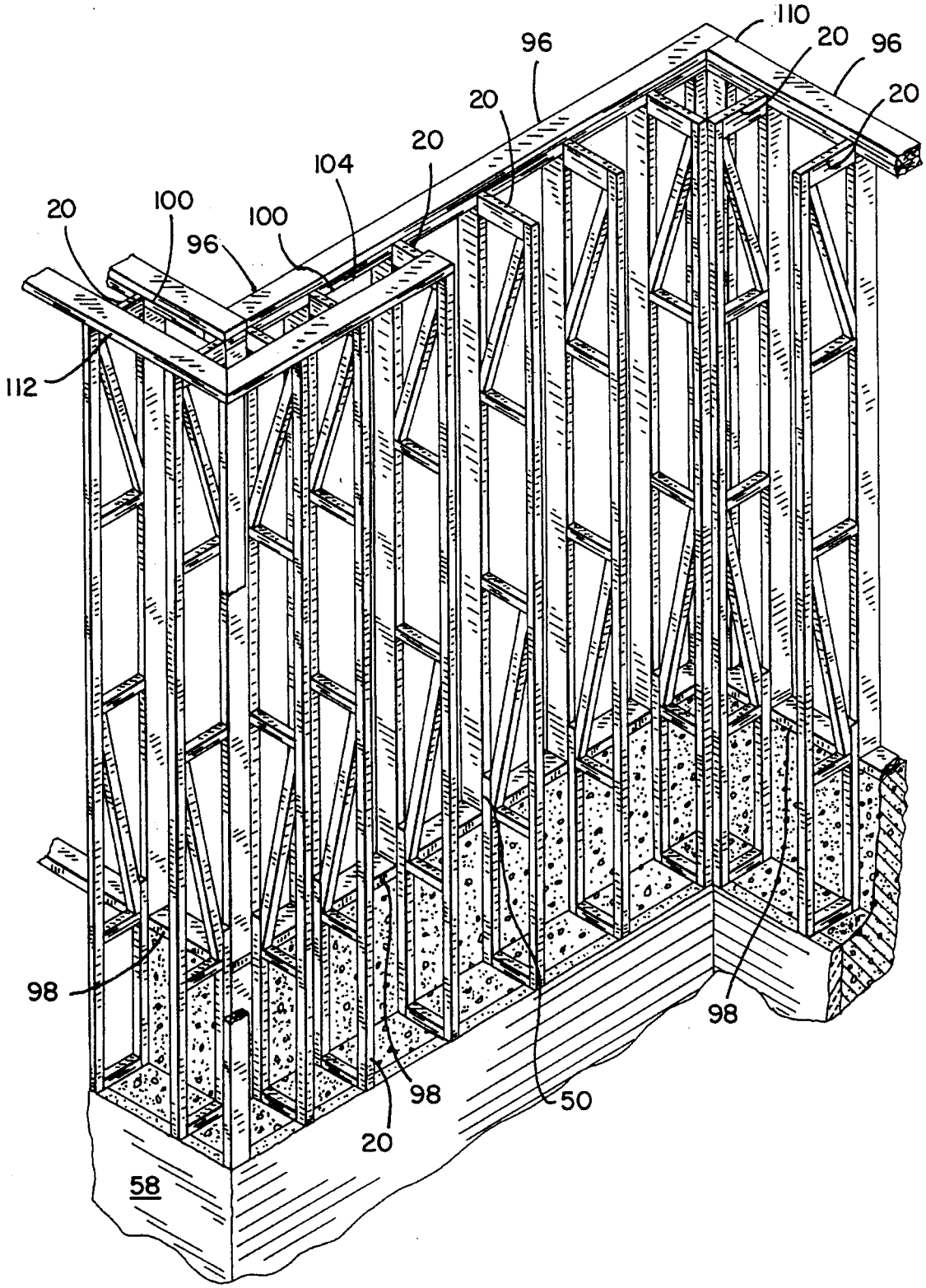
FIG. 3 is a isometric view of a super-insulated wall constructed with the trusses of FIG. 2.

Referring more particularly to FIGS. 1–5 wherein like numbers refer to similar parts, a wall truss 20 is shown in FIG. 2. The wall truss is constructed of a two-by-four stud 22 and an exterior two-by-two stud 24. The two-by-two 24 is spaced from the stud two-by-four 22 by an upper spacer 26, an upper mid-spacer 28, a lower mid-spacer 30, and a lower spacer 32. An upper diagonal brace 36 extends between the juncture 38 of the stud 22 with the upper mid-spacer 28 and the juncture 40 of the exterior two-by-two 24 and the upper spacer 26. Similarly, a lower diagonal brace 42 extends between the juncture 44 of the lower spacer 32 and a sill extension piece 48 adjacent the stud 22 to the juncture 46 of the exterior two-by-two 24 and the lower mid-spacer 30. The sill extension piece 48 overlaps a portion 50 of the outer face 52 of the stud 22 adjacent to the lower end 54 forming a box sill 55. The sill extension 48 extends down into a sill step 56 in a foundation wall 58. The sill extension 48 is joined to the exterior stud 24 by sill spacer 34.

The wall truss 20 is joined together by a series of opposed truss plates 60. For the wall truss 20, shown in FIG. 2, a series of ten pairs of truss plates 60 are employed with ten plates on each side of the wall truss 20. Starting at the top 62 of the stud 22 an inside top plate 64 joins the upper spacer 26 to the stud 22. An outer top plate 66 joins the exterior two-by-two 24, the upper spacer 26 and the upper diagonal brace 36. An inner upper mid-plate 68 covers the juncture 38 of the stud 22 with the upper diagonal brace 36 and the upper mid-spacer 28. An outer upper mid plate 70 joins the upper mid-spacer 28 to the exterior two-by-two 24. An outer lower mid plate 74 joins the lower mid-spacer 30 to the stud 22. An outer lower mid plate 74 joins the lower mid-spacer 30 to the exterior two-by-two 24 and the lower diagonal brace 42. An inner low& mid plate 72 joins the lower mid-spacer 30. An inner lower plate 76 joins the lower diagonal brace 42 and the sill extension piece 48 to the stud 22. The outer lower plate 78 joins the lower spacer 32 to the exterior two-by-two 24. The inner sill plate 80 joins the sill spacer 34 to the sill extension piece 48 and the outer sill plate joins the sill spacer 34 to the exterior two-by-two 24. The inner sill plate 80 joins the sill spacer 34 to the sill extension piece 48 and the outer sill plate 82 joins the sill spacer 34 to the exterior two-by-two.

In each case, the plates 64–82 are positioned on both sides of the truss 20. As shown in FIG. 2, the truss plates 60 are dimensioned with respect to the joint they are forming. In particular, the outside top plate 66, the inside upper mid plate 68, the outside lower mid plate 74 and the inner lower plate 76 are of a size to overlap all of the members which come together when those plates are positioned. In particular, the inner lower plate 76, which joins four members, is the largest plate.

The trusses 20 are assembled using pre-engineered truss plates 60 which are engineered to hold specific loads and which are applied by rolling or pressing the plates onto the truss 20 as shown in FIGS. 4 and 5. Each plate is constructed of sheet metal with numerous stamped projections extending out of the plate. The plate is positioned over the juncture of the framing members and rolled or pushed into the wood where the projections of the plate, in effect, nail the components of the truss 20 to the truss plate 60, thus joining the members together.

By fabricating the trusses 20 off the job site considerable labor savings can be achieved in their construction. The labor savings is produced by utilizing specialized labor of lower skill than job-site labor and utilizing jigs and automatic equipment for cutting and assembling the trusses 20. In addition to lower cost, a higher quality product can be produced at the factory site because of the great uniformity in the conditions under which the trusses 20 are manufactured. In addition, the ability to inspect, test and monitor quality is facilitated by the factory environment. A factory also serves as a site for the engineering and design of trusses for a particular application.

The trusses would typically be ordered by giving the ceiling heights, the total thickness or width of the truss desired, the length of the box sill and whether the primary stud should be a two-by-four or two-by-six. An engineer at the factory will then design, perhaps aided by a computer, a particular truss for that application. Thus, the trusses may be of varying heights and the number of diagonal braces and spacers will vary depending on the height of the truss. At the truss fabrication shop, the short trusses for use under and over windows and other openings will also be fabricated for shipment to the job site.

The trusses 20 are formed by taking the precut component parts, studs, spacers, and diagonals, and assembling them on a jig table 126 as shown in FIGS. 4 and 5. The truss plates 60 are the positioned over the joints 128 between components and a roller 130 or a press-plate 132 forces the plates 60 into engagement with the wood of the truss components. The truss 20 is turned over and the process is repeated.

The basic truss 20, as shown in FIG. 2, is what is supplied to the job site. The sequence of construction normally starts with the foundation 58 on which is placed a sill plate timber 84 on which the floor or deck 86 of the building 88 is constructed. The deck 86 is constructed of floor joists 90 which are nailed to end plates 92 and sheathed with plywood or strand board 94. At this point, or shortly before, the trusses 20 are delivered to the job site.

The deck 86 is now used to construct the walls 96 of the building 88. The trusses 20 will normally be spaced sixteen or twenty-four inches on center and joined together by bottom plates 98—which join the lower ends 54 of the studs 22; and top plates 100—which join the tops 62 of the studs 22 together. The walls thus formed are raised in the conventional manner to form the exterior walls 96 of a building 88.

The studs 22 of the trusses 20 overlie, the outside corner 102 of the deck 86 with the long dimension of the two-by-four or two-by-six stud 22 being aligned perpendicular or normal to the exterior walls 96. Each truss 20 extends normally or outwardly of the exterior walls 96 to define an insulating space or volume 104 in which is placed insulation, typically chopped fiberglass or cellulose. The box sill 55 hangs down beneath the bottom plate and alongside the end plate 92 of the deck 86. The foundation 58 may have a step 56 for receiving the box sill 55. The box sill 55 will normally extend downwardly to the grade surrounding the foundation 58.

Where two story buildings are constructed, the sill box of the second story truss (not shown) will extend downwardly over the second floor deck. The second floor trusses will normally extend outwardly of the exterior walls by the same amount as the first floor trusses 20 so that sheathing 108 may be continuous between the first and second floors.

To prevent deterioration due to foundation moisture the sill spacer 34, the exterior stud 24, and the sill extension 48 may be constructed of treated timber. Alternatively, or in addition, a vapor barrier, for example constructed of six to eight thousandths of an inch of polyvinyl plastic, may underlie and separate the box sill 55 from the foundation 58.

Once the exterior walls 96 are assembled as shown in FIG. 3, a second top plate 110 overlying the top plate 100 is used to tie segments of the walls together. Similarly, an outer top plate 112 ties together and stabilizes the outside edge 114 of the trusses 20. The roof trusses 116 may then be positioned as shown in FIG. 1 and may then overlie the walls 96 to form the building. Internal sheathing 118, normally consisting of drywall, is then attached to the inner surfaces of the studs 22 in a conventional manner.

It should be understood the studs 22 may be constructed of two-by-four or two-by-six dimensional timber and the spacers 28, 30, 32 and 34, together with the hanging stud or cord 24 and the diagonal braces 36, 42 and the sill extension piece 48, will all be formed of two-by-two dimensional lumber. The upper spacer 26 is normally a two-by-four.

It should also be understood that wherein dimensions of lumber such as 2×4, 2×6 and 2×2 are to be understood as having their ordinary meaning within the construction trade, namely that the actual dimensions of the timber members are somewhat less than the given dimensions due to planing of the rough sawn timber. So, for example, a 2×4 actually measures approximately 1⅝" by 3½.

It should be understood the inside and outside wall corners as shown in FIG. 3 are framing details and are merely representative. Such details and others associated with windows, doors and other openings are design choices generally made at the construction site by the construction crews.

It is understood that the invention is not limited to the particular construction and arrangement of parts herein illustrated and described, but embraces such modified forms thereof as come within the scope of the following claims.

I claim:

1. A factory-fabricated structural truss for fabricating super-insulated walls of a building, comprising:

a) a vertically disposed first stud selected from the group of dimensioned timbers consisting of 2×4's and 2×6's, the stud positioned to form a portion of an exterior wall of a building, wherein the first stud has lower portions which face outwardly;

b) a second stud spaced outwardly from and parallel to the first stud, wherein the second stud has a thickness substantially the same as the first stud and a width in the outward direction substantially less than the width in the outward direction of the first stud;

c) a plurality of wood spacers which extend horizontally between the first stud and the second stud;

d) at least one diagonal wood member extending on a diagonal between the first stud and the second stud to stiffen the truss;

e) an extension wood member that is positioned adjacent to outwardly facing lower portions and which extends below the first stud, wherein the second stud extends downwardly in spaced parallel relation to the extension member to form a portion of the truss which extends downwardly below the first stud, wherein the extension member is spaced a first distance from the second stud, and the first stud is spaced a distance from the second stud which is greater than said first distance; and f) a plurality of pairs of metal truss plates joining the spacers, wherein the spacers and said at least one diagonal member are connected to the first stud and the second stud by said truss plates, and the extension member is connected to said first stud by said truss plates.

2. The truss of claim 1 wherein the truss has at least two diagonal wooden members extending diagonally between the first stud and the second stud to provide stiffness to the truss.

3. The truss of claim 1 wherein the plurality of wood spacers are selected so the truss has a total width in the outward direction of about twelve inches.

4. The truss of claim 1 wherein the extension member has a lower end and the second stud has a lower end and further comprising a spacer wood member joining said extension member lower end to said second stud lower end.

5. The truss of claim 1 wherein the plurality of wood spacers includes at least one spacer positioned uppermost on the truss, and wherein said uppermost positioned spacer is constructed of two-by-four dimensional timber.

6. The truss of claim 5 wherein the wood spacers, other than the uppermost wood spacer, are constructed of two-by-two dimensional timbers.

7. A truss for fabrication of super-insulated walls of a building, the truss comprising:

a) a vertically disposed first stud selected from the group of dimensioned timbers consisting of 2×4's and 2×6's, the stud positioned to form a portion of an exterior wall of a building;

b) a second stud positioned in spaced parallel relation to the first stud and positioned outwardly of the first stud, wherein the second stud is a 2×2;

c) a plurality of wood spacers extending horizontally between the first stud and the second stud;

d) at least one diagonal wood member extending at a diagonal between the first stud and the second stud to provide stiffness to the truss;

e) an extension wood member adjacent to and outward from the first stud, and which extends below the first stud, wherein the second stud extends downwardly in spaced parallel relation to the extension member to form a portion of the truss which extends downwardly from the first stud, and wherein the second stud is closer to the extension member than to the first stud; and f) a plurality of pairs of metal truss plates joining the spacers, the extension member, and the diagonal member to the first stud and the second stud, wherein the truss plates have a plurality of protrusions extending therefrom, and are applied by positioning at least one of each pair of truss plates over a jig holding the spacers, the extension member and the diagonal member in relation to the first stud and the second stud to form the truss, and rolling a roller over said spacers to engage said truss plate protrusions with the wood, connecting the spacers, extension member and the diagonal member to the first and second studs to form the truss.

8. A truss for fabrication of super-insulated walls of a building, the truss comprising:

a) a vertically disposed first stud selected from the group of dimensioned timbers consisting of 2×4's and 2×6's, the stud positioned to form a portion of an exterior wall of a building, wherein the first stud has lower portions which face outwardly;

b) a second stud positioned in spaced parallel relation to the first stud and positioned spaced in a direction along the line normal to the exterior wall, wherein the second stud is a 2×2;

c) a plurality of wood spacers which extend horizontally between the first stud and the second stud;

d) at least one diagonal wood member extending on a diagonal between the first stud and the second stud to stiffen the truss;

e) an extension wood member that is positioned adjacent to the outwardly facing lower portions and which extends below the first stud, wherein the second stud extends downwardly in spaced parallel relation to the extension member to form a portion of the truss which extends downwardly below the first stud, wherein the extension member is spaced a first distance from the second stud, and the first stud is spaced a distance from the second stud which is greater than said first distance; and f) a plurality of pairs of metal truss plates joining the spacers, the extension member and the diagonal member to the first stud and the second stud, wherein the truss plates are applied by positioning at least one of each pair of truss plates over a jig holding the spacers, extension member and the diagonal member to the first stud and the second stud in a position to form the truss, and stamping the at least one of each pair of truss plates into engagement with the wood spacers, extension member, and the diagonal member, and the first stud and the second stud to form the truss.

9. A super-insulated exterior wall in a building having a horizontal deck, the wall comprising:

a) a first vertical truss having a vertically extending first stud selected from the group of dimensioned timbers consisting of 2×4's and 2×6's, engaged with a horizontally extending bottom plate supported on the deck, wherein a second stud is spaced outwardly from the first stud by a plurality of wooden spacers, and wherein the second stud is narrower in the outward direction than the first stud, and wherein at least one diagonal member extends at an angle from the horizontal between the first stud and the second stud and is connected thereto, and wherein the spacers and the diagonal member are connected between the first stud and the second stud by a plurality of metal truss plates;

b) a second vertical truss substantially the same as the first vertical truss and spaced sidewardly from said tint vertical truss and engaged with the bottom plate;

c) a first extension member connected to the first stud of the first vertical truss and extending downwardly below the bottom plate, wherein the second stud of the first vertical truss is spaced outwardly from the extension member; and d) a second extension member connected to the first stud of the second vertical truss and extending downwardly below the bottom plate, wherein the second stud of the second vertical truss is spaced outwardly from the second extension member, and wherein a space is defined which is adapted to receive a quantity of insulative material between the first truss and the second truss extensions members to insulate the building deck.

* * * * *